US006227470B1

(12) United States Patent
Chevalier et al.

(10) Patent No.: US 6,227,470 B1
(45) Date of Patent: May 8, 2001

(54) RING-ROLLER CRUSHER

(75) Inventors: Philippe Chevalier, Boissets; Alain Cordonnier, Lille; Philippe Lagache, Isle d'Abeau; Christophe Obry, Steen Werck, all of (FR)

(73) Assignee: FCB, Montreuil (FR)

( * ) Notice: Subject to any disclaimer, the term of this patent is extended or adjusted under 35 U.S.C. 154(b) by 0 days.

(21) Appl. No.: 09/403,261

(22) PCT Filed: Apr. 15, 1997

(86) PCT No.: PCT/FR97/00680

§ 371 Date: Nov. 2, 1999

§ 102(e) Date: Nov. 2, 1999

(87) PCT Pub. No.: WO98/46356

PCT Pub. Date: Oct. 22, 1998

(51) Int. Cl.[7] ..... B02C 4/32
(52) U.S. Cl. ..... 241/228
(58) Field of Search ..... 241/228

(56) References Cited

U.S. PATENT DOCUMENTS 5,060,874 * 10/1991 Sidney .
5,192,030 * 3/1993 Jakobs .

FOREIGN PATENT DOCUMENTS

2246720 * 2/1992 (GB) .

* cited by examiner

*Primary Examiner*—Mark Rosenbaum
(74) *Attorney, Agent, or Firm*—Harrison & Egbert

(57) ABSTRACT

A grinder constituted by a ring (10) having a horizontal axis, a mechanism for driving the ring in rotation about its axis, at least one roller (16) the axis of which is parallel to that of the ring and which is placed inside the latter so as to be able to travel over its internal surface and elastic member (30) for pressing the roller against the ring, the roller being supported at its ends by two arms (22) mounted on the frame of the grinder so as to be able to pivot about an axis parallel to the axis of the ring.

7 Claims, 2 Drawing Sheets

RING-ROLLER CRUSHER

TECHNICAL FIELD

The invention relates to grinders constituted by a ring with a horizontal axis, driven in rotation about its axis by appropriate means, and at least one roller, the axis of which is parallel to that of the ring and which is placed inside the latter so as to be able to travel over its internal surface, which forms a grinding track, and including elastic means, such as springs or hydro-pneumatic jacks, for pressing the roller against the ring, with grinding being effected by crushing the material between the roller and the ring.

The invention relates more particularly to grinders of this type in which the roller is supported at its ends by two arms mounted on the frame of the grinder so as to be able to pivot about one and the same axis parallel to the axis of the ring, with the elastic pressure means acting upon the arms.

BACKGROUND ART

In these grinders, when the material to be ground is not uniformly distributed over the entire width of the grinding track, particularly when large pieces are introduced onto the track, the roller tends to position itself slantwise in relation to the ring, which reduces its efficiency. To overcome this drawback, the two arms could be attached rigidly to one another, but this would lead, in the event of a large piece or of a nongrindable object passing between the ring and the roller, to the grinding force exerted by the roller being concentrated on a reduced area of the ring, with the occurrence of excessive mechanical stresses in the roller and the ring.

The object of the present invention is to provide simple means for limiting the slantwise positioning of the roller in relation to the ring while, at the same time, limiting the grinding pressures and, consequently, the mechanical stresses, to within acceptable values, as well as for contributing to a reduction in the oscillatory movements of the roller and its supports.

SUMMARY OF THE INVENTION

According to the invention, the two arms are connected to one another by a torsion shaft parallel to the axis of rotation of the arms. This shaft can be disposed in the axis of rotation of the arms, or outside this axis, on the same side as the roller in relation to the axis, or on the other side.

BRIEF DESCRIPTION OF THE DRAWINGS

The following description refers to the accompanying drawings, which show, by way of a non-limitative example, two forms of embodiment of the invention, and wherein.

DETAILED DESCRIPTION OF THE INVENTION

Figure 1:
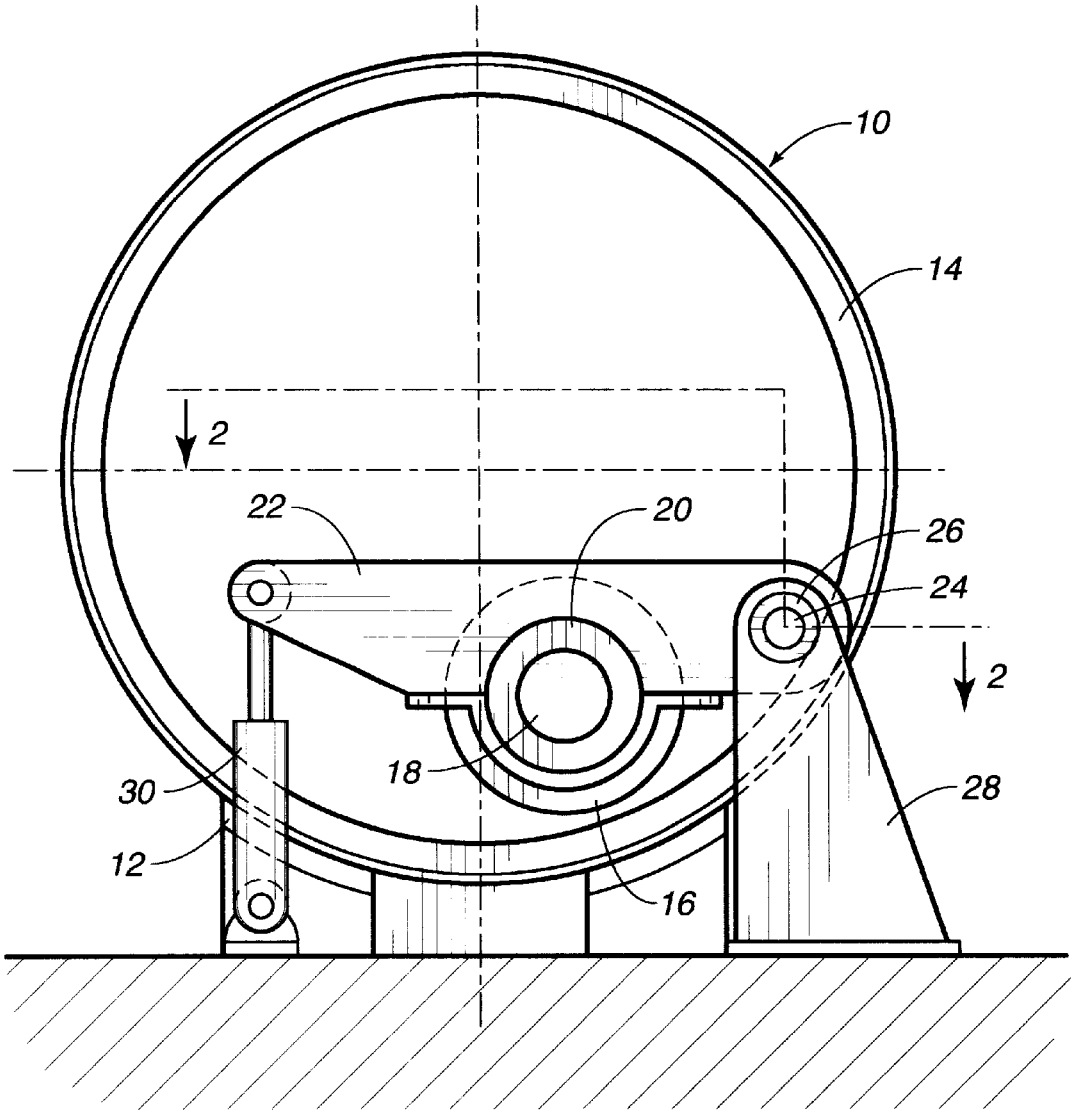
FIG. 1 is a side view of a ring type grinder, produced according to the invention
Figure 2:
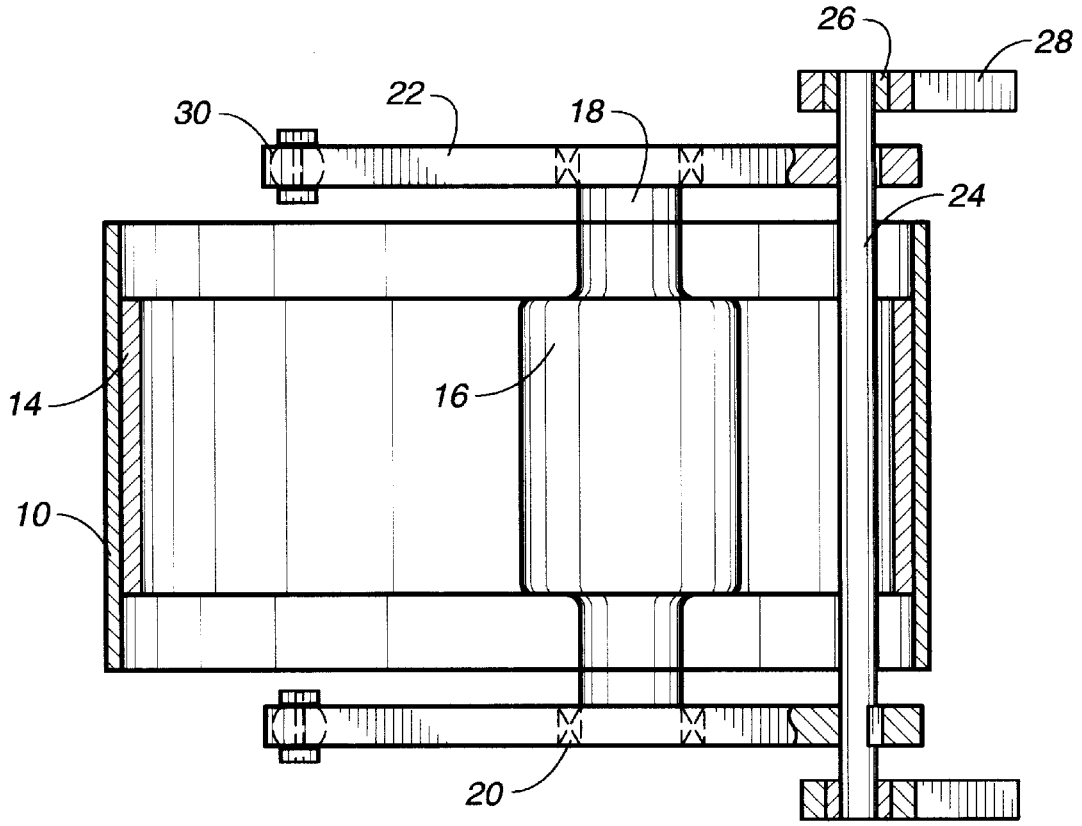
FIG. 2 is a cross-section along line 2—2 of FIG. 1.

The grinder shown in FIGS. 1 and 2 is constituted by a ring 10, having a horizontal axis, which is supported by shoes or skids 12 permitting its rotation about its axis. These shoes could be replaced by bushings or rollers. The ring is driven in rotation by conventional means, not shown, for example by a motor and a reducer the output shaft of which bears a gear or pinion engaged with a toothed wheel fixed to the ring.

The ring is formed by a shell internally clad with wear plates which, in its median portion, form an annular grinding track 14.

The ring is closed, at its ends, by fixed end portions to which are connected a supply chute, at one end, and a discharge chute and a suction conduit for pneumatically evacuating the fine particles, at the other end. These elements are not shown in the drawings.

A roller 16, the axis of which is parallel to the axis of the ring, is placed inside the ring so as to be able to travel over track 14 when the ring is driven in rotation, in no-load condition. When the grinder is in a production mode, the roller travels over the layer of material covering the track. The roller is provided with two shaft ends or stub shafts 18 mounted in bearings 20 fixed to two arms 22 disposed outside the ring, on respective opposite sides thereof. The bearings 20 are fixed between the opposite ends of the arms 22. One of the ends of arms 22 is fixed, for example by keying, to a shaft 24, the axis of which is parallel to the axis of the roller and which is supported at its ends by bearings 26 mounted on seats or supports 28.

Hydraulic jacks 30 connect the other end of arms 22 to the frame of the grinder or to the foundations and enable the roller to be pressed against the track. These jacks are supplied from a hydraulic plant or unit, which makes it possible to regulate the pressure in the jacks and, consequently, the force exerted by the roller upon the layer of material covering the track.

The torsional strength characteristics of shaft 24 are such that it permits a certain angular deflection of arms 22 in relation to one another. Its role is to limit the slantwise positioning of the roller in relation to the track when the roller is raised by an localized additional thickness of the layer of material, preventing an excessive pressure from being exerted locally on the layer of material and the track liable to set up abnormal mechanical stresses in the roller and the track. It also contributes to reducing the oscillatory movements of the roller and arms 22.

In the form of embodiment shown in FIGS. 1 and 2, shaft 24 serves both as a pivotal axis for arm 22 and as a torsion shaft. These two functions could be separated. For example, arms 22 could be mounted so as to be rotary, independently of one another, on a shaft disposed like shaft 24, and the torsion shaft could be a tubular shaft, coaxial with the former, and the ends of which would be fixed to arms 22. Instead of passing through the ring, as in the example shown, shaft 24 could be placed outside the ring.

Figure 3:
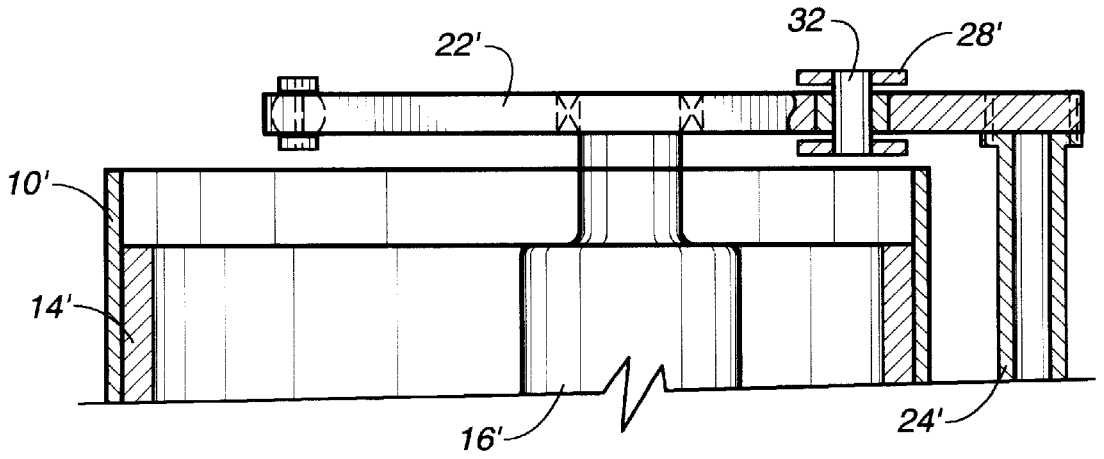
FIG. 3 is a partial view, analogous to FIG. 2, showing another form of embodiment of the invention.

FIG. 3 shows another form of embodiment according to which the torsion shaft is at a distance from the pivotal axis of arms 22' supporting roller 16', instead of being disposed coaxially, as in the grinder of FIGS. 1 and 2. Each arm 22' is articulated here on a shaft end 32 mounted on a seat or support 28' and the two arms are connected together by a tubular torsion shaft 24' disposed on the side opposite the roller in relation to the pivotal axis of the arms. This arrangement enables the torsion shaft to be placed outside the ring, which has definite advantages. It should be noted that, in the grinder of FIG. 3, the torsion shaft also works in flexion and it is clearly to be understood that the expression torsion shaft, as used in the description and the claims, does not exclude this form of embodiment and does not imply that the shaft works solely in torsion.

Other forms and arrangements of the support arms of the roller and of the torsion shaft could be adopted without departing from the scope of the invention as defined in the claims.

What is claimed is:

1. A grinder apparatus comprising:

a frame;

a ring having a horizontal axis and an internal surface;

a means connected to said ring for driving said ring in rotation around said horizontal axis;

at least one roller having a longitudinal axis parallel to said horizontal axis of said ring, said roller positioned within said ring so as to travel over said internal surface of said ring, said roller being supported at opposite ends thereof by two arms mounted on said frame, said roller being pivotable by said two arms about an axis parallel to said horizontal axis of said ring, said two arms being connected by a torsion shaft to each other, said torsion shaft having a longitudinal axis parallel to said axis of said two arms.

2. The grinder apparatus of claim 1, said torsion shaft being disposed in the pivot axis of said two arms.

3. The grinder apparatus of claim 2, said two arms being respectively keyed to said torsion shaft, said torsion shaft being supported at opposite ends thereof by bearings mounted on said frame.

4. The grinder apparatus of claim 1, said torsion shaft being positioned at a spaced distance from the pivot axis of said two arms.

5. The grinder apparatus of claim 1, said torsion shaft extending through an interior of said ring.

6. The grinder apparatus of claim 1, said torsion shaft positioned exterior of said ring.

7. The grinder apparatus of claim 1, said torsion shaft being a tubular member.

* * * * *